US008955261B2

(12) United States Patent
Kobe et al.

(10) Patent No.: US 8,955,261 B2
(45) Date of Patent: Feb. 17, 2015

(54) RETAIL MARKETING ENVIRONMENT

(71) Applicant: Hearts On Fire Company, LLC, Boston, MA (US)

(72) Inventors: Tim Kobe, Singapore (SG); Hilary Clark, New York, NY (US); Mike Ely, Berkeley, CA (US); Lucinda Tay, San Francisco, CA (US); David Herman, San Francisco, CA (US); Sheldon Baker, Brooklyn, NY (US); Angela Wisco, San Francisco, CA (US)

(73) Assignee: Hearts On Fire Company, LLC, Boston, MA (US)

( * ) Notice: Subject to any disclaimer, the term of this patent is extended or adjusted under 35 U.S.C. 154(b) by 0 days.

(21) Appl. No.: 13/723,439

(22) Filed: Dec. 21, 2012

(65) Prior Publication Data

US 2013/0192153 A1 Aug. 1, 2013

Related U.S. Application Data

(60) Provisional application No. 61/581,424, filed on Dec. 29, 2011.

(51) Int. Cl.
*E04H 1/00* (2006.01)
*E04H 3/02* (2006.01)
(Continued)

(52) U.S. Cl.
CPC *E04H 3/02* (2013.01); *F21V 21/02* (2013.01); *E04H 1/1222* (2013.01)
USPC ..... 52/79.1

(58) Field of Classification Search
CPC ..... E04H 3/02; E04H 3/04; E04H 1/06; E04H 1/12; E04H 1/1272; E04H 1/1222; E04H 1/1266
USPC ..... 52/79.1, 234; 186/52
See application file for complete search history.

(56) References Cited

U.S. PATENT DOCUMENTS 1,404,613 A * 1/1922 Hormes ..... 434/72
4,177,612 A * 12/1979 Tochihara ..... 52/28
(Continued)

FOREIGN PATENT DOCUMENTS

| | | |
|---|---|---|
| JP | 2005-042383 | 2/2005 |
| WO | WO 94/29839 | 12/1994 |
| WO | WO 02/055797 | 7/2002 |

OTHER PUBLICATIONS

International Search Report mailed on Apr. 22, 2013 in International Patent Application No. PCT/US2012/071162.
(Continued)

*Primary Examiner* — Jessica Laux
(74) *Attorney, Agent, or Firm* — DLA Piper LLP (US)

(57) ABSTRACT

Retail marketing environments of the present technology include retail stores and store layouts that provide a plurality of experience zones to guide a consumer through a purchasing experience. The first experience zone includes the front façade of the retail store and at least one window display case displaying merchandise that can be viewed through the front window. The second experience zone includes an interactive display that provides product information to consumers. The third experience zone includes at least one merchandise display area and at least one merchandise handling area. The fourth experience zone includes a plurality of interaction areas in which consumers can interact with store employees. A veil wall can be used to separate one or more of the experience zones.

10 Claims, 7 Drawing Sheets

(51) Int. Cl.
*F21V 21/02* (2006.01)
*E04H 1/12* (2006.01)

(56) References Cited

U.S. PATENT DOCUMENTS

| | | | | |
|---|---|---|---|---|
| 4,274,233 | A * | 6/1981 | Currier | 52/33 |
| 6,311,441 | B1 | 11/2001 | Beavers et al. | |
| 8,583,481 | B2 * | 11/2013 | Viveiros et al. | 705/14.4 |
| 2002/0104271 | A1 * | 8/2002 | Gallant | 52/36.1 |
| 2004/0187401 | A1 * | 9/2004 | Krestakos et al. | 52/79.1 |
| 2005/0086876 | A1 * | 4/2005 | Clark | 52/79.1 |
| 2006/0150547 | A1 * | 7/2006 | Menard | 52/236.3 |
| 2008/0104895 | A1 * | 5/2008 | Deweerd et al. | 52/79.9 |
| 2008/0313973 | A1 * | 12/2008 | Butler | 52/79.1 |
| 2009/0114481 | A1 * | 5/2009 | Tejada et al. | 186/52 |
| 2011/0041434 | A1 * | 2/2011 | Solomon et al. | 52/234 |
| 2011/0132691 | A1 * | 6/2011 | Menard | 186/52 |
| 2011/0266337 | A1 | 11/2011 | Reynolds et al. | |

OTHER PUBLICATIONS

Written Opinion of International Searching Authority mailed on Apr. 22, 2013 in International Patent Application No. PCT/US2012/071162.

English language abstract for JP 2005-042383 published Feb. 17, 2005.

English language translation for JP 2005-042383 piblished Feb. 17, 2005.

* cited by examiner

RETAIL MARKETING ENVIRONMENT

CROSS-REFERENCE TO RELATED APPLICATIONS

This application is based on and derives the benefit of the filing date of U.S. Provisional Patent Application No. 61/581,424, filed Dec. 29, 2011. The entire content of this application is herein incorporated by reference in its entirety.

FIELD OF THE INVENTION

The present technology relates to retail marketing environments, and in particular to a retail store layout that provides a plurality of experience zones to guide a consumer through a purchasing experience.

DESCRIPTION OF RELATED ART

Retail marketing environments for articles of merchandise that are particularly valuable, such as small electronics and jewelry, present the articles on display and require a customer to interact with a sales employee in order to actually procure an article that they desire to purchase.

Such retail marketing environments generally have a plurality of display cases that sit on the floor and include at least one clear front window through which a customer can view the merchandise displayed within the case, creating a counter where a store employee is on one side of the display case and the customer on the opposite side. Such display cases normally have a lockable sliding back panel that can be opened by the employee, who can then reach into the display case to either stock the case or remove merchandise for inspection by a customer.

SUMMARY OF THE INVENTION

The present technology relates to retail marketing environments in which consumers peruse articles of merchandise displayed in display cases and then interact with an employee in order to inspect and/or procure a particular article of merchandise. Retail marketing environments of the present technology include retail stores and store layouts that provide a plurality of experience zones to guide a consumer through a purchasing experience.

Retail marketing environments of the present technology include a retail store and a layout for the retail store. The retail store includes a front façade including at least one front window and at least one door, a first outer side wall connected to the front façade, and a second outer side wall connected to the front façade. The layout for the retail store includes a first experience zone, a second experience zone, a third experience zone and a fourth experience zone. The first experience zone includes the front façade and at least one window display case displaying merchandise that can be viewed through the front window. The second experience zone includes an interactive display that provides product information. The third experience zone includes at least one merchandise display area and at least one merchandise handling area. The fourth experience zone includes a plurality of interaction areas in which consumers can interact with store employees.

In some examples, a veil wall can be employed to separate one or more of the experience zones in a retail marketing environment of the present technology. A veil wall can include a plurality of vertical members, each vertical member being spaced apart from each other vertical member a sufficient amount to allow a consumer to see through the veil wall.

A veil wall can also include at least one light adjacent to one end of a vertical member, the light being directed to shine onto the vertical member.

BRIEF DESCRIPTION OF THE DRAWINGS

Specific examples have been chosen for purposes of illustration and description, and are shown in the accompanying drawings, forming a part of the specification.

DETAILED DESCRIPTION OF SEVERAL EMBODIMENTS

The purchasing experience provided to a customer in a retail environment can have an impact on how the consumer perceives the quality and nature of the brand associated with the articles of merchandise. For example, the layout of a retail store is the environment in which consumers form an impression of the articles of merchandise on display within the retail store. In a retail environment where consumers are encouraged to engage, experiment, learn, and express at whatever level is appropriate for them, the consumer may feel more comfortable during the retail purchasing experience, and may thus feel more positively inclined towards the brand associated with the articles of merchandise.

Retail marketing environments of the present technology include retail store layouts that provide a plurality of experience zones through which a consumer passes during a retail purchasing experience. Each experience zone has a different purpose, and provides the consumer with a different level of interaction with the store employees and with the articles of merchandise on display for purchase.

Figure 1:
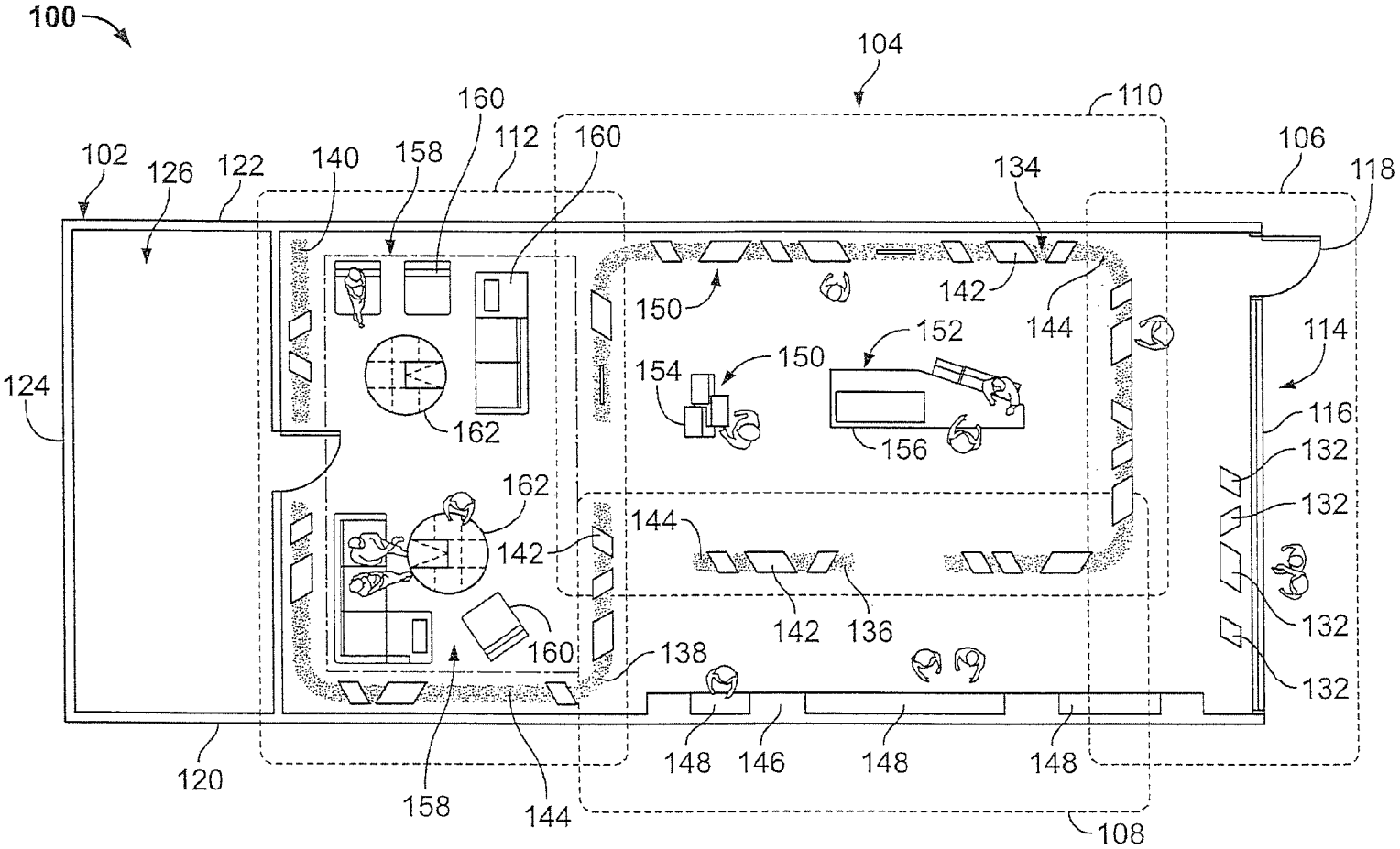
FIG. 1 illustrates a diagram of one example of a retail marketing environment of the present technology.
Figure 2:
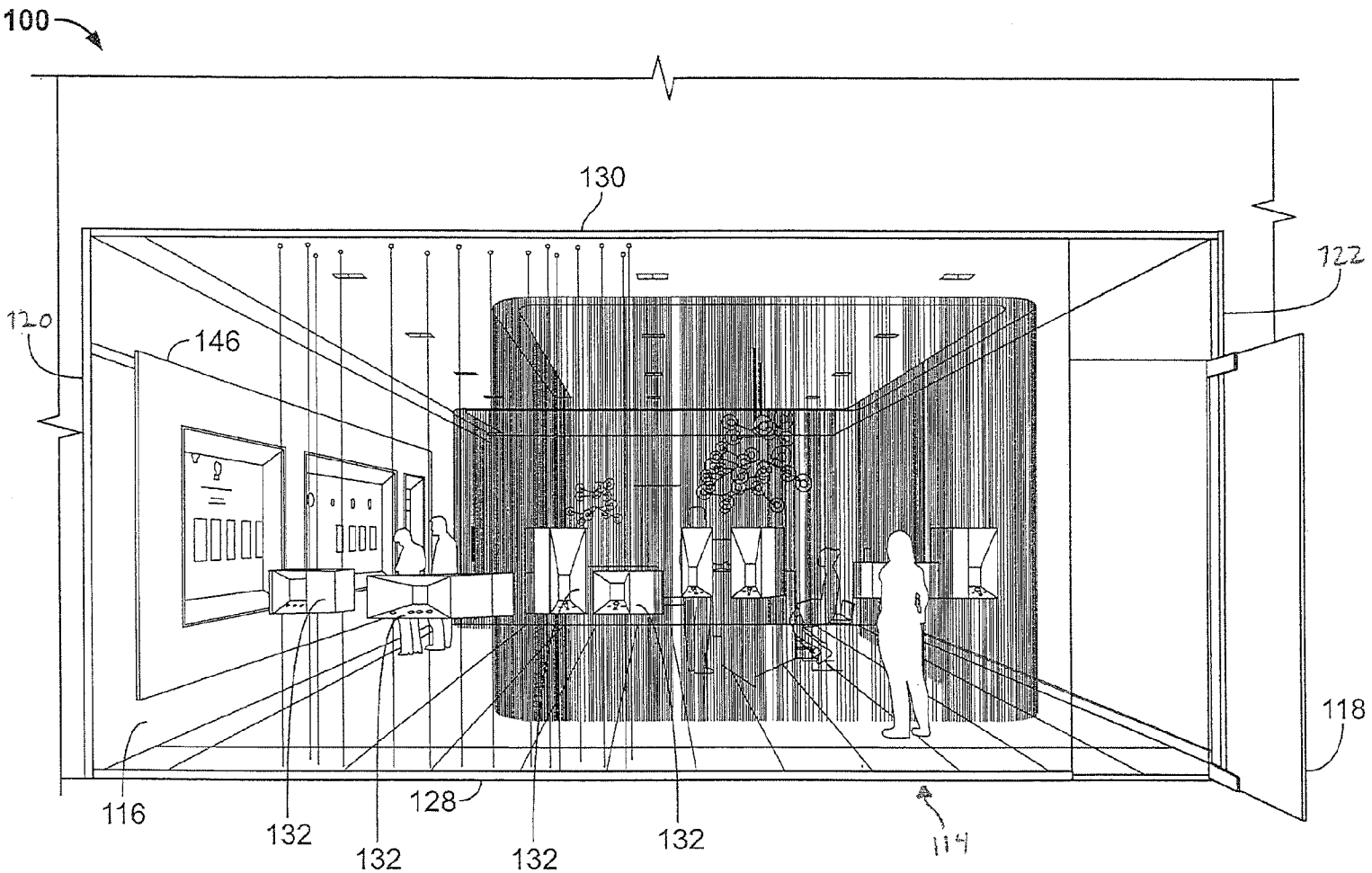
FIG. 2 illustrates a front view of the retail marketing environment of FIG. 1.

FIGS. 1 and 2 show one example of a retail marketing environment 100 of the present technology that includes a retail store 102 and a layout 104 for the retail store. As illustrated, the layout 104 includes at least four experience zones, including a first experience zone 106, a second experience zone 108, a third experience zone 110, and a fourth experience zone 112. As illustrated by the dotted outlines of each experience zone, the experience zones can overlap to at least some extent, which may facilitate providing smooth transitions to a consumer, and a more coherent retail purchasing experience.

As a matter of basic physical structure, the retail store 102 can have a front façade 114, which can include at least one front window 116 and at least one door 118 to provide entrance into and egress from the retail store 102. The retail store 102 can also include a first outer side wall 120 connected to the front façade 114, a second outer side wall 122 connected to the front façade 114. The retail store can also include a rear wall 124 connected to the first outer sidewall 120 and the second outer sidewall 122, and a rear support area 126. In the illustrated example, the at least one front window 116 extends horizontally from the first outer side wall 120 to the door 118, as can extend vertically from the floor 128 up to the ceiling 130 of the retail store 102, providing a full view of the interior of the retail store 102.

In the retail marketing environment 100 shown in FIGS. 1 and 2, the experience zones are separated by a plurality of display walls 134, 136, 138, and 140. Each display wall includes at least one interior display case 142 and dividing material 144. Preferably, each display wall includes a plurality of interior display cases 142. The dividing material 144 can be a solid wall, or any other suitable type of wall, including for example a veil wall, which includes a plurality of vertical members, as described in further detail below. When the display wall includes a plurality of vertical members, each display case 142 can be mounted on at least one vertical member.

The first experience zone 106 is an intrigue zone, which is located at the front of the retail store 102. The first experience zone 106 includes the front façade 114 of the retail store 102, and also includes at least one window display case 132 displaying merchandise that can be viewed through the front window 116. As shown in FIG. 1, the first experience zone 106 can also include at least a portion of a first display wall 134.

The second experience zone 108 is a knowledge zone in which a consumer can obtain product information, such as information about the articles of merchandise available for sale, the brand associated with the articles of merchandise, and/or additional services available to consumers that purchase the articles of merchandise. The second experience zone 108 can include an interactive display 146 that provides the product information. As illustrated, the interactive display 146 is a wall mounted display, which includes a plurality of touch screens 148, and at least one consumer can operate each touch screen at any given time.

The third experience zone 110 is a tangible zone, in which consumers can view displayed merchandise and have a store employee remove merchandise from display for inspection and handling by the consumer. Accordingly, the third experience zone can include at least one merchandise display area 150 and at least one merchandise handling area 152. The at least one merchandise display area can include one or more interior display cases 142 on a display wall, and can also include at least one standing display case 154. The at least one merchandise handling area can include a communal table 156, at which one or more consumers can interact with one or more store employees.

The fourth experience zone 112 is a relationship zone, which can include a plurality of interaction areas 158, in which consumers can interact with store employees. Each interaction area can include at least one table 162 and a plurality of seats 160. In the fourth experience zone, consumers and store employees can interact on a more personal level than is possible in the other experience zones.

Figure 3:
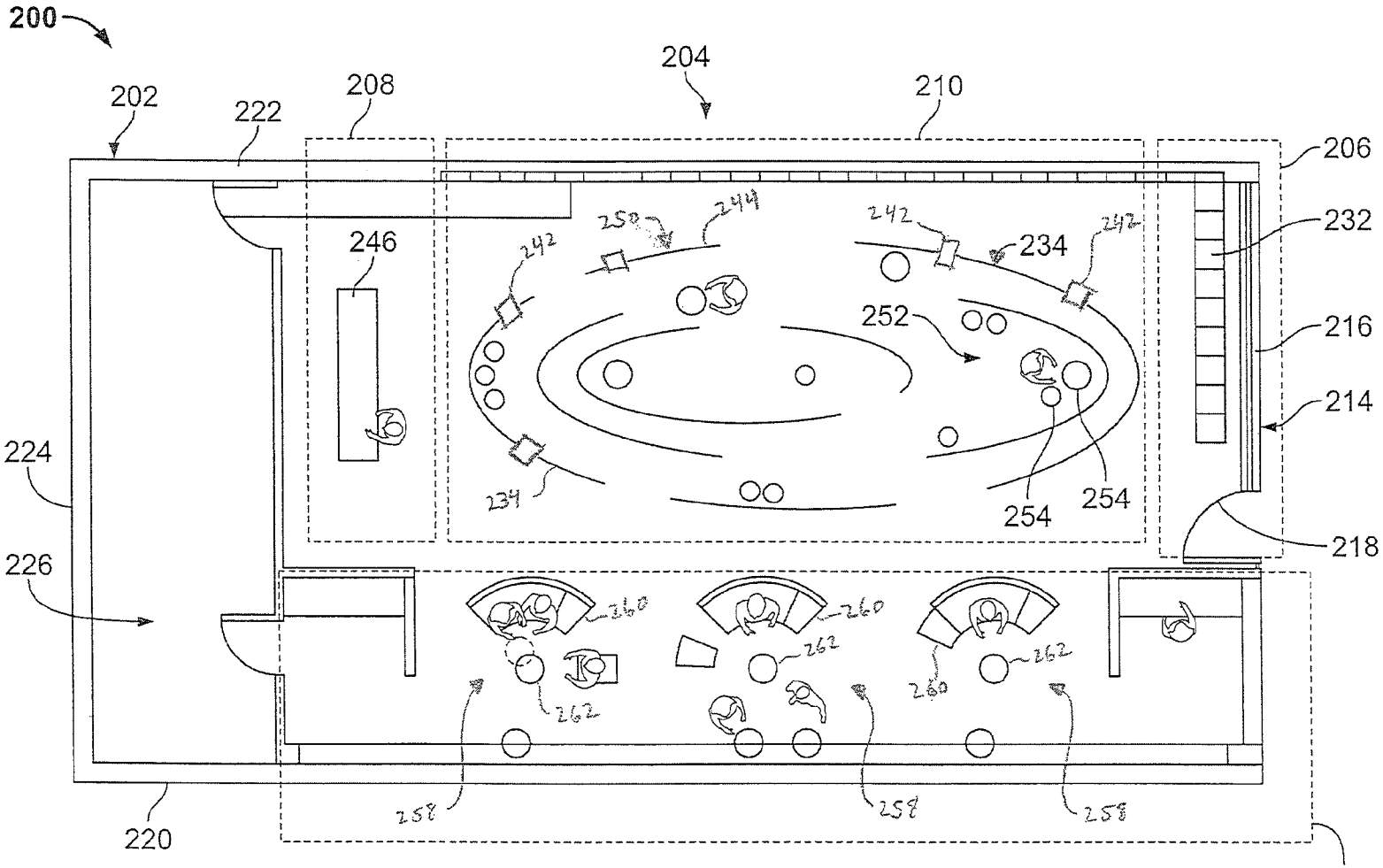
FIG. 3 illustrates a diagram of a second example of a retail marketing environment of the present technology.

FIG. 3 shows a second example of a retail marketing environment 200 of the present technology that includes a retail store 202 and a layout 204 for the retail store. As illustrated, the layout 204 includes at least four experience zones, including a first experience zone 206, a second experience zone 208, a third experience zone 210, and a fourth experience zone 112. As illustrated by the dotted outlines of each experience zone, the experience zones can be adjacent to each other.

As with the example of FIGS. 1 and 2, the retail store 202 shown in FIG. 3 can have a front façade 214, which can include at least one front window 216 and at least one door 218 to provide entrance into and egress from the retail store 202. The retail store 202 can also include a first outer side wall 220, a second outer side wall 222, a rear wall 224, and a rear support area 226.

The first experience zone 206 is an intrigue zone, which is located at the front of the retail store 202. The first experience zone 206 includes the front façade 214 of the retail store 202, and also includes at least one window display case 232 displaying merchandise that can be viewed through the front window 216.

The second experience zone 208 is a knowledge zone in which a consumer can obtain product information, such as information about the articles of merchandise available for sale, the brand associated with the articles of merchandise, and/or additional services available to consumers that purchase the articles of merchandise. The second experience zone 208 can include an interactive display 246 that provides the product information. As illustrated the interactive display 246 is a counter, which can includes a plurality of touch screens, and at least one consumer can operate each touch screen at any given time.

The third experience zone 210 is a tangible zone, in which consumers can view displayed merchandise and have a store employee remove merchandise from display for inspection and handling by the consumer. Accordingly, the third experience zone can include at least one merchandise display area 250 and at least one merchandise handling area 252. The at least one merchandise display area includes a plurality of display walls 234. Each display wall 234 can include at least one interior display case 242 and dividing material 244. Preferably, each display wall includes a plurality of interior display cases 242. The dividing material 244 can be a solid wall, or any other suitable type of wall, including for example a veil wall, which includes a plurality of vertical members, as described in further detail below. When the display wall includes a plurality of vertical members, each display case 242 can be mounted on at leak one vertical member.

The fourth experience zone 212 is a relationship zone, which can include a plurality of interaction areas 258, in which consumers can interact with store employees. Each interaction area can include at least one table 262 and a plurality of seats 260. In the fourth experience zone, consumers and store employees can interact on a more personal level than is possible in the other experience zones.

Figure 4:
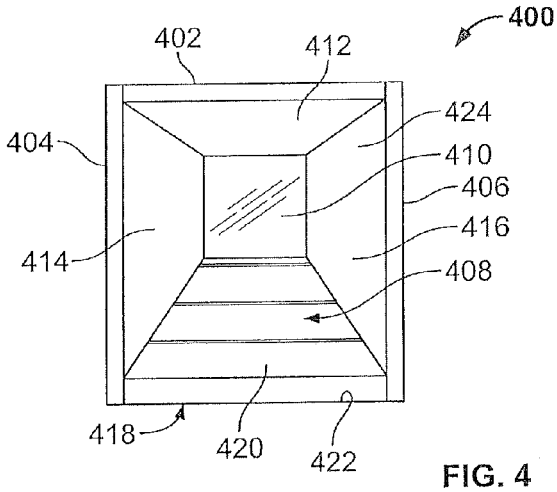
FIG. 4 illustrates a first example of a display case that can be used in a retail marketing environment of the present technology.
Figure 5:
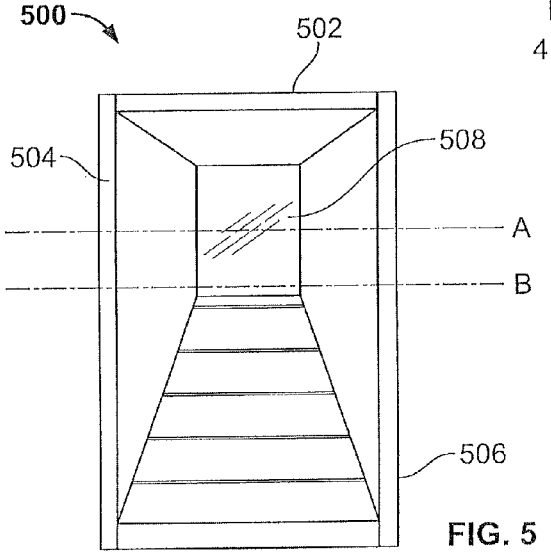
FIG. 5 illustrates a second example of a display case that can be used in a retail marketing environment of the present technology.
Figure 6:
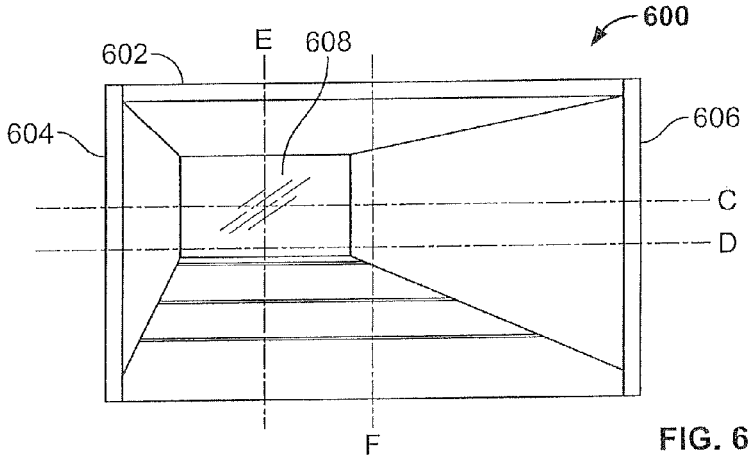
FIG. 6 illustrates a third example of a display case that can be used in a retail marketing environment of the present technology.

FIGS. 4 through 6 show front views of various examples of interior display cases of the present technology, looking through the front viewing panel into a display area of the cases. Some examples of suitable display cases for use as interior display cases of the present technology are described in U.S. Provisional Application Ser. No. 61/581,415, entitled "Mounted Display Case," which is filed concurrently herewith, the content of which is hereby incorporated by reference herein in its entirety.

The front of interior display case 400 as shown in FIG. 4 has a square shape. The interior display case has a top 402, a left side 404, a right side 406, and a display area 408. The display area 408 includes a back panel 410, a top panel 412 attached to the top 402, a left side panel 414 attached to the left sidewall 404, a right side panel 416 attached to the right sidewall 406, and a display drawer 418. The display drawer 418 is configured to hold merchandise that can be viewed through a front viewing pane 424 attached to the top 402 and sidewalls 404, 406 of the display case 400. The display drawer 418 can include a display face 420, on which merchandise can be displayed, and a bottom grip 422. The display face 420 can be inclined from the back of the display area 408 at its top end to the front of the display area 408 at its bottom end when the display drawer 418 is in the closed position. The display drawer 418 can be slidably connected to a frame including the sidewalls 404 and 406, and can slide from a closed position to an open position. In the closed position, the display drawer 418 can be enclosed within the display area 408. In the open position, the display drawer 120 can be extended beneath the display area 408. A store employee can grip the bottom grip 422 of the display case to apply force and move the display drawer 418 form the closed position to the open position.

The front of display case 500 as shown in FIG. 5 is rectangular, with the left sidewall 504 and the right sidewall 506 having a length that is greater than the length of the top 502. The display case can have panels and a display drawer as described above with respect to FIG. 4. The back panel 508 of the display case 500 can be positioned at a desired height, and can be placed off-center. For example, the back panel 508 can be placed vertically off-center such that such that a horizontal centerline A of the back panel 508 is above a horizontal centerline B of the display case 500.

The front of display case 600 as shown in FIG. 6 is rectangular, with the left sidewall 604 and the right sidewall 606 having a length that is less than the length of the top 602. The display case can have panels and a display drawer as described above with respect to FIG. 4. The back panel 608 of the display case 600 can be positioned at a desired height, and can be placed off-center. For example, the back panel 608 can be placed vertically off-center such that such that a horizontal centerline C of the back panel 608 is above a horizontal centerline D of the display case 600. The back panel 608 can also be positioned horizontally off-center, for example, as illustrated, such that a vertical centerline E of the back panel 608 can be to the left of a vertical centerline F of the display case 600.

Figure 7:
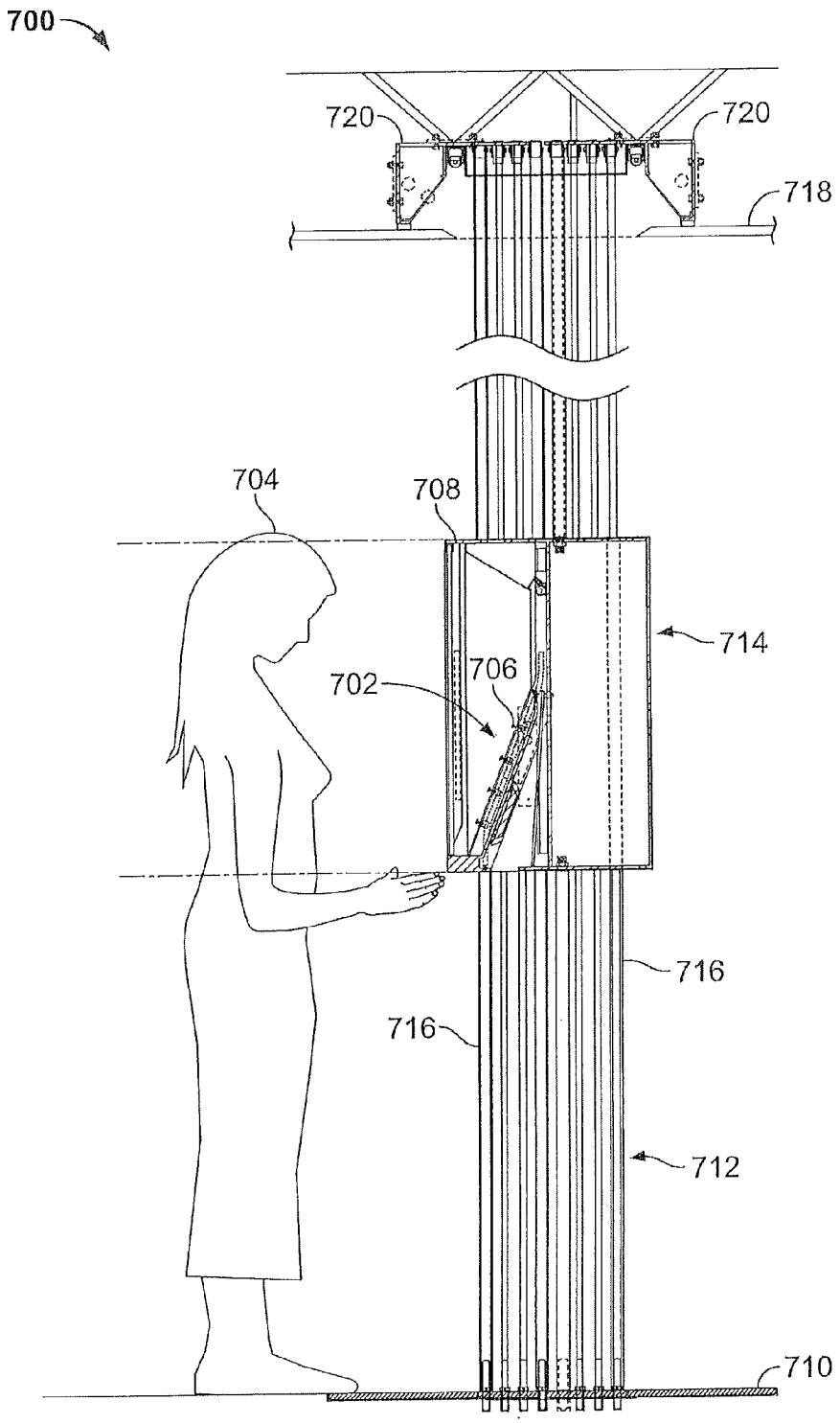
FIG. 7 illustrates a single-sided example of the display case of FIG. 4 mounted on a veil wall of the present technology.
Figure 8:
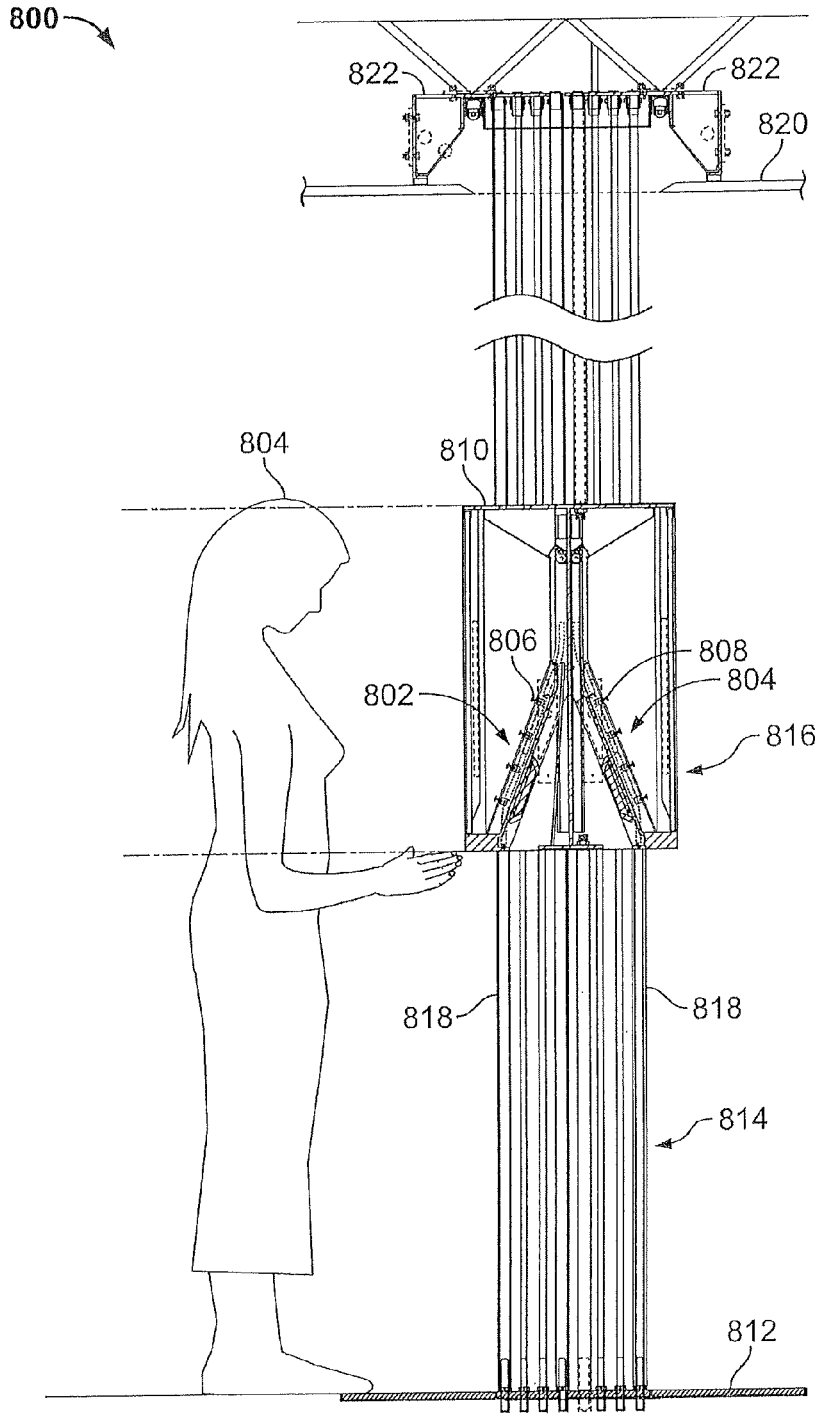
FIG. 8 illustrates a double-sided example of the display case of FIG. 4 mounted on a veil wall of the present technology.

FIGS. 7 and 8 illustrate examples of display walls 700 and 800 of the present technology, respectively. As shown in FIG. 7, some display cases of the present technology can be single sided, having a only a first display area 702 at the front of the display case 714. As shown in FIG. 8, some display cases of the present technology can be double-sided, having a first display area 802 at the front of the display case 816 and a second display area 804 at the rear of the display case 816.

As shown in FIGS. 7 and 8, display cases of the present technology can be mounted at any suitable height, including for example at a height that places the viewing areas 702, 802, 804 of the display case in line with the head and chest of a consumer 704, 804 viewing merchandise 706, 806, 808. In some examples, a display case 700, 800 can be mounted such that the top 708, 810 of the case is at a height that is from about 5 feet to about 7 feet from the floor 710, 812 of the retail store.

Also as shown in FIGS. 7 and 8, the dividing material 712, 814 of each display wall 700, 800 is a veil wall, which includes a plurality of vertical members 716, 818. Each vertical member 716, 818 can be spaced apart from each other vertical member 716, 818 by an amount that is sufficient to allow a consumer to see through the veil wall, which can allow a consumer to see into other experience zones. Each vertical member 716, 818 can be rigid, and can be solid or hollow. In one example, at least one vertical member 716, 818 is hollow so that cables can be installed therein to provide power to the display case 714, 816. Each display case 714, 816 can be mounted on one or more of the spaced vertical members 716, 818. The spaced vertical members 716, 818 can extend from the floor 710, 812 of the retail store into the ceiling 718, 820 of the retail store. Each vertical member 716, 818 can be attached to the floor 710, 812 at a bottom end of the vertical member 716, 818. Each vertical member 716, 818 can also, or alternatively, be attached to structure in the ceiling 718, 820 at a top end of the vertical member 716, 818.

Each vertical member 716, 818 can have a cross-sectional area. The cross-sectional area of each vertical member 716, 818 can be any suitable shape, which can be the same or different from the shape of the cross-sectional area of any other vertical member 716, 818. For examples, each vertical member 716, 818 can have a cross-sectional shape that is a circle, an oval, a quadrangle, or any other regular or irregular shape. The cross-sectional area of each vertical member 716, 818 can also be any suitable size, which can be the same or different from the size of the cross-sectional area of any other vertical member 716, 818. For example, the plurality of vertical members 716, 818 in any given veil wall can include vertical members 716, 818 having one or more sizes of cross-sectional area. In one example, the plurality of vertical members 716, 818 in a veil wall includes vertical members 716, 818 having at least two sizes of cross-sectional area.

Each vertical member 716, 818 can be made of any suitable material, including for example metal or plastic. In at least some examples, vertical members 716, 818 can be made of a reflective material or have a reflective coating, so as to have a reflective surface.

Each veil wall, such as display walls 700, 800 can also include at least one light adjacent to one end of a vertical member, the light being directed to shine onto the vertical member. As shown in FIGS. 7 and 8, there is at least one recessed light 720, 822 located above the ceiling 718, 820. Each recessed light 720, 822 can shine light onto the spaced vertical members 716, 818.

Figure 9:
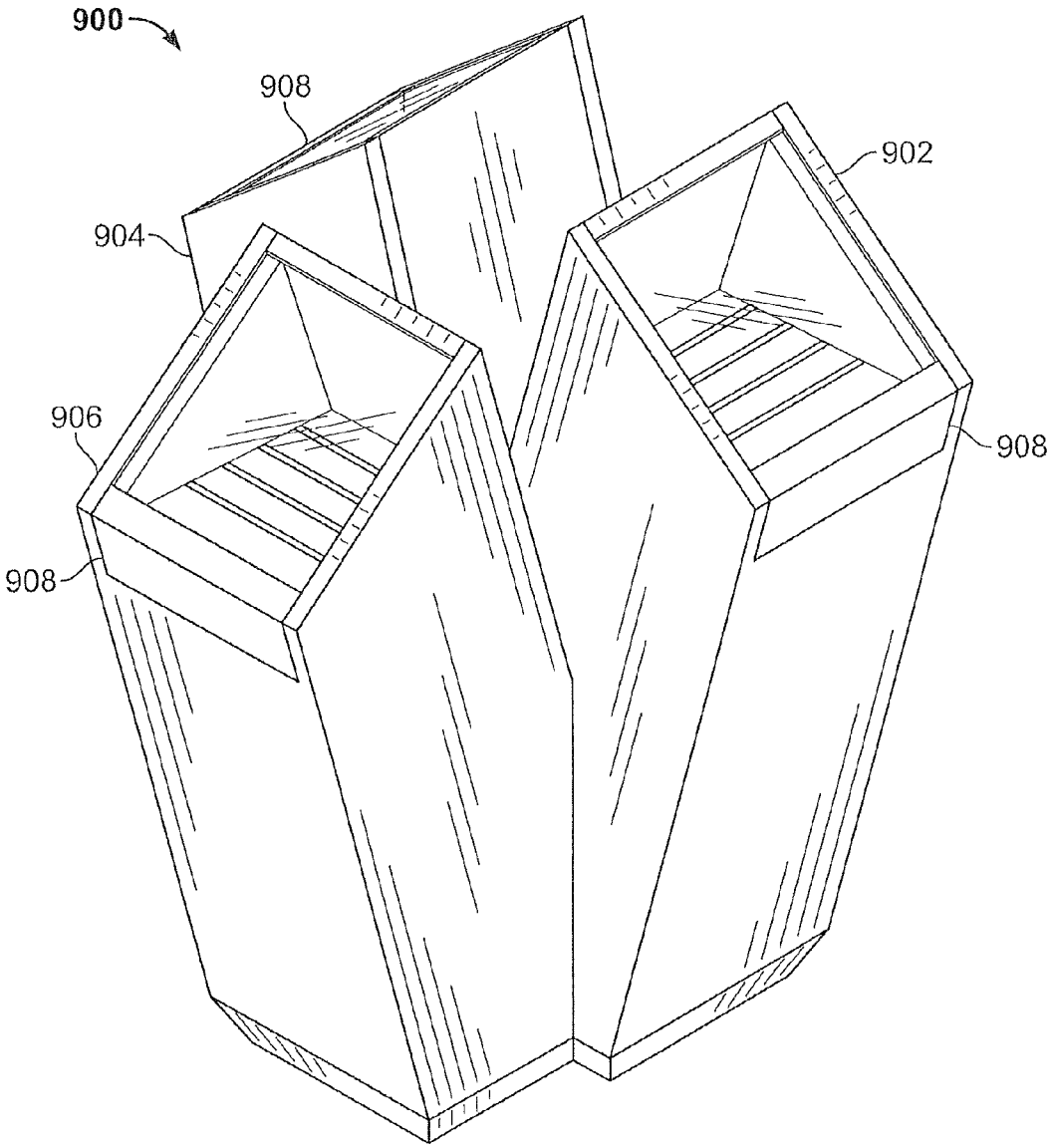
FIG. 9 illustrates one example of a standing display case that can be used in a retail marketing environment of the present technology.

FIG. 9 shows one example of a standing display case 900 of the present technology. One type of display case suitable for use as a standing display case 900 is described in U.S. Design Registration No. D668081, entitled "Standing Display Case," which has been filed concurrently herewith, the disclosure of which is hereby incorporated by reference herein in its entirety. As shown in FIG. 9, standing display case 900 has a plurality of display areas, including first display area 902, second display area 904, and third display area 906. Each display area has a display drawer 908 in which articles of merchandise can be displayed.

From the foregoing, it will be appreciated that although specific examples have been described herein for purposes of illustration, various modifications may be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

What is claimed is:

1. A retail marketing environment comprising:

A. a retail store, the retail store comprising:

a front façade including at least one front window and at least one door, and a plurality of display walls, each display wall including at least one display case and dividing material, where the at least one display case is mounted to the dividing material, the dividing material of each display wall consisting of a plurality of spaced vertical members, each vertical member being spaced apart from each other vertical member a sufficient amount to allow a consumer to see through the display wall; and B. a layout for the retail store, the layout comprising a plurality of experience zones through which a consumer can pass during a retail purchasing experience, the plurality of experience zones comprising:

a first experience zone located at a front of the retail store, the first experience zone including the front façade and at least one window display case displaying merchandise that can be viewed through the front window;

a second experience zone that includes an interactive display that provides product information;

a third experience zone that includes at least one merchandise display area and at least one merchandise handling area, the merchandise display area including one or more display cases mounted on a display wall and the at least one merchandise handling area including a communal table constructed and arranged for a plurality of customers to interact with one or more retail employees; and a fourth experience zone that includes a plurality of interaction areas in which consumers can interact with store employees.

2. The retail marketing environment of claim 1, wherein the first experience zone further includes at least a portion of a first display wall.

3. The retail marketing environment of claim 1, wherein each experience zone is separated from the other experience zones by at least a portion of one display wall.

4. The retail marketing environment of claim 1, wherein the spaced vertical members extend from a floor of the retail store into a ceiling of the retail store.

5. The retail marketing environment of claim 4, wherein each display wall further comprises at least one recessed light above the ceiling that is directed to shine light onto the spaced vertical members.

6. The retail marketing environment of claim 1, wherein the interactive display comprises a plurality of touch screens.

7. The retail marketing environment of claim 1, wherein the at least one merchandise display area further comprises a standing display case.

8. The retail marketing environment of claim 1, wherein the at least one merchandise handling area comprises a plurality of individual tables at which a consumer can view merchandise.

9. The retail marketing environment of claim 1, wherein each interaction area comprises a table and a plurality of seats.

10. The retail marketing environment of claim 1, wherein the spaced vertical members comprise vertical members having at least two sizes of cross-sectional area.

* * * * *